United States Patent [19]

Pavoz et al.

[11] Patent Number: 5,062,501

[45] Date of Patent: Nov. 5, 1991

[54] ELEVATOR WITH LINEAR MOTOR COUNTERWEIGHT ASSEMBLY

[75] Inventors: Marcel Pavoz, Nanterre, France; Ernest P. Gagnon, Manchester, Conn.

[73] Assignee: Otis Elevator Company, N.J.

[21] Appl. No.: 518,275

[22] Filed: May 4, 1990

Related U.S. Application Data

[63] Continuation of Ser. No. 318,293, Mar. 3, 1989, abandoned.

[51] Int. Cl.[5] ..... B66B 1/06

[52] U.S. Cl. ..... 187/112; 187/108

[58] Field of Search ..... 187/108, 112, 94; 318/135

[56] References Cited

U.S. PATENT DOCUMENTS

| | | | |
|---|---|---|---|
| 3,101,130 | 8/1963 | Bianca | 187/94 X |
| 4,402,386 | 9/1983 | Ficheux et al. | 187/112 |
| 4,570,753 | 2/1986 | Ohta et al. | 187/94 X |

FOREIGN PATENT DOCUMENTS

| | | |
|---|---|---|
| 62-136476 | 8/1987 | Japan . |
| 63-117884 | 5/1988 | Japan . |

*Primary Examiner*—A. D. Pellinen
*Assistant Examiner*—Lawrence E. Colbert
*Attorney, Agent, or Firm*—Lloyd D. Doigan

[57] ABSTRACT

The elevator has a linear motor-counterweight assembly which provides the driving power for moving the elevator car. The linear motor is a flat linear motor which runs on a flat strip of steel which is partially coated with a layer of aluminum, copper or the like conductor. The side margins of the steel strip are not coated with the conductor metal, and serve as bearing surfaces for the guide rollers on the counterweight. The counterweight has modular brakes mounted on it which engage the margins of the steel strip to control movement of the counterweight and elevator car. The brakes are electromechanical brakes which are silenced for use in the elevator environment. The counterweight may also have safety gears mounted thereon which also act upon the margins of the steel strip for emergency braking of the counterweight.

8 Claims, 6 Drawing Sheets

ELEVATOR WITH LINEAR MOTOR COUNTERWEIGHT ASSEMBLY

"This is a continuation of copending application(s) Ser. No. 07/318,293 filed on Mar. 3, 1989, now aband."

TECHNICAL FIELD

This invention relates to an elevator assembly, and more particularly to an elevator assembly having a linear motor mounted on the elevator counterweight for driving the elevator.

BACKGROUND ART

Elevators having a linear motor mounted on the counterweight are known in the prior art. German Offenlegungsschrift No. 2,002,081, published Jan. 19, 1970; German Offenlegungsschrift No. 3,422,374, published Dec. 19, 1985; U.S. Pat. No. 4,402,386, granted Sept. 6, 1983; and Japanese Patent Publication No. 61-260678, published May 21, 1988 all disclose elevators with linear motors mounted on the Counterweight for providing the motive power for an elevator. The armature of the motor is a pole or rail mounted in the hoistway over which the motor will run. The use of such a linear motor drive eliminates the need for a separate motor room in the building in which the elevators are located. Such elevators are also very quiet, and thus are highly desirable from the passenger's view point.

While such elevator assemblies are highly desirable, there exist certain problems relative to the linear elevator assemblies which are disclosed in the aforesaid prior art. The above-noted German reference discloses a linear motor mounted on a counterweight assembly which motor uses the counterweight standard guide rails as its armature. One problem which arises with this approach relates to the induced magnetic flux which is required to power the elevator. Standard guide rails do not provide enough cross-sectional area to provide for the flux magnitude which is needed. Another problem with this approach relates to the desirability of coating the armature with a layer of a highly conductive metal such as aluminum or copper. This thin metal layer is desirable since it improves the efficiency of the motor. When the conductive coating or layer is applied to a guide rail, however, that guide rail then cannot be used for car stop braking or for emergency braking because the conductive coating would be worn off of the rail quickly. Using that rail to guide the counterweight movement is also undesirable because guide rollers or guide shoes can wear the coating off of the rail.

In the aforesaid U.S. Pat. No. 4,402,386, a hollow cylindrical guide rail is used in conjunction with a toroidal linear motor. The guide rail can consist of an aluminum layer coated onto a solid steel column so that sufficient rail cross-sectional area is achieved. The operating brakes are mounted on the elevator car and act upon the car guide rails. The use of the aluminum coated steel column solves the cross-sectional area problem of the German reference, but the aluminum coating is still subject to abrasion from the counterweight guide rollers. Additionally, the weight of the coated steel column limits its use to relatively low rise applications. Inclusion of safety gears on the counterweight would damage the armature once the safeties are used.

The Japanese reference proposes the use of coated conventional guide rails as a double armature for a multiple linear motor assembly mounted on the counterweight. Guide rollers contact the coated rails, and electromagnetic operational brakes are mounted on the counterweight to engage the rails. This type of arrangement will encounter the wear problems described above, and is thus undesirable. Counterweight safety gears are also ruled out as an option since they will damage the guide rail armatures if activated. The Japanese reference also shows a second embodiment which uses a flat steel plate coated with a conductive metal layer as the armature for the linear motor. Separate guide rails are used to guide movement of the counterweight in the second embodiment. Rollers contact the coated part of the armature to properly space the motor from the armature. Thus the coating can be damaged by the rollers, and the assembly is complex due to the use of the separate guide rails.

DISCLOSURE OF THE INVENTION

This invention relates to an elevator counterweight assembly which incorporates a linear motor, and to an armature/counterweight guide which eliminates all of the aforesaid wear, damage, and complexity problems of the prior art. The assembly of this invention also includes modular operating brakes which are mounted on the counterweight, and separate safety gears mounted on the counterweight. Operation of either the brakes or the safety gears will not damage the armature in any way. The armature for the linear motor is a flat steel strip which has the central portion of one face coated with a layer of a highly conductive metal, such as aluminum. The coated surface faces the coils of the linear motor. Both side margins of the steel strip are left uncoated, and provide exposed steel for engagement by guide rollers for the counterweight, for operating brakes mounted on the counterweight, and for safety gears mounted on the counterweight. Thus, a single armature/guide is provided for the counterweight and linear motor, but the problem of wear and damage to the armature from its use as a guide is eliminated.

It is therefore an object of this invention to provide an elevator assembly with a counterweight that incorporates a linear motor to provide the motive force for the elevator car.

It is further object of this invention to provide and elevator assembly of the character described wherein the counterweight guide is a steel strip which also serves as an armature for the linear motor.

It is an additional object of this invention to provide an elevator assembly of the character described wherein the steel strip guide is coated with a highly conductive metal to improve operation of the linear motor.

It is another object of this invention to provide an elevator assembly of the character described wherein the steel strip guide has uncoated portions which can be engaged by elements on the counterweight without damaging the armature.

It is yet another object of this invention to provide an elevator assembly of the character described having modular operating brakes mounted on the counterweight for engagement with the uncoated portions of the steel strip guide.

This and other objects and advantages of the invention will become more readily apparent from the following detailed description of the preferred embodiment thereof when taken in conjunction with the accompanying drawings, in which:

BEST MODE FOR CARRYING OUT THE INVENTION

Figure 1:
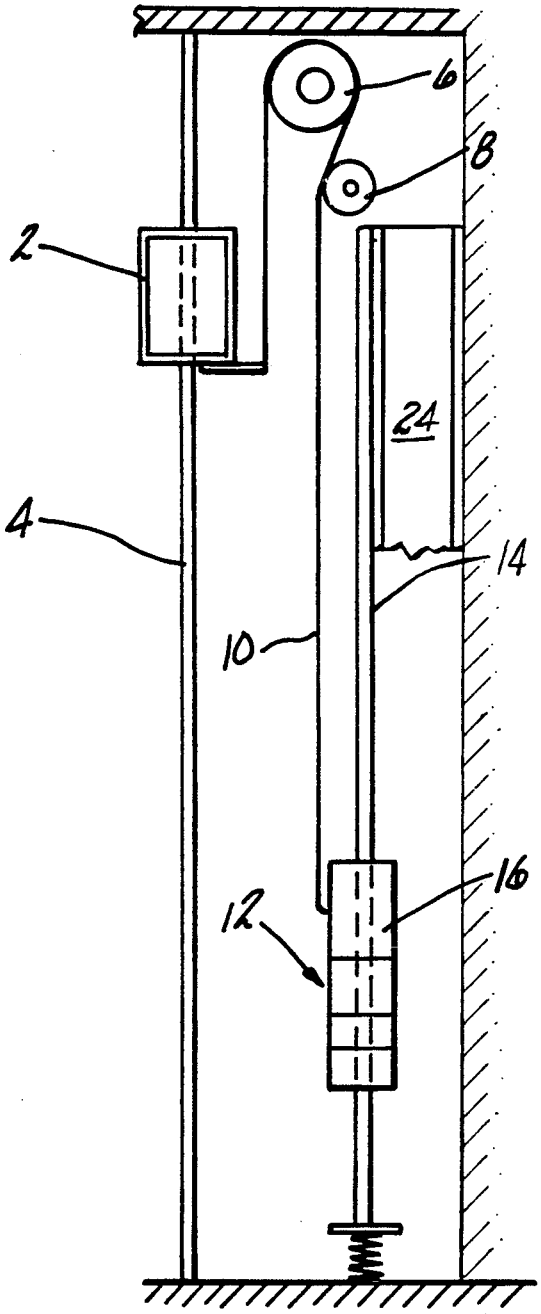
FIG. 1 is a schematic representation of an elevator assembly having a linear motor mounted on the counterweight of the elevator.
Figure 2:
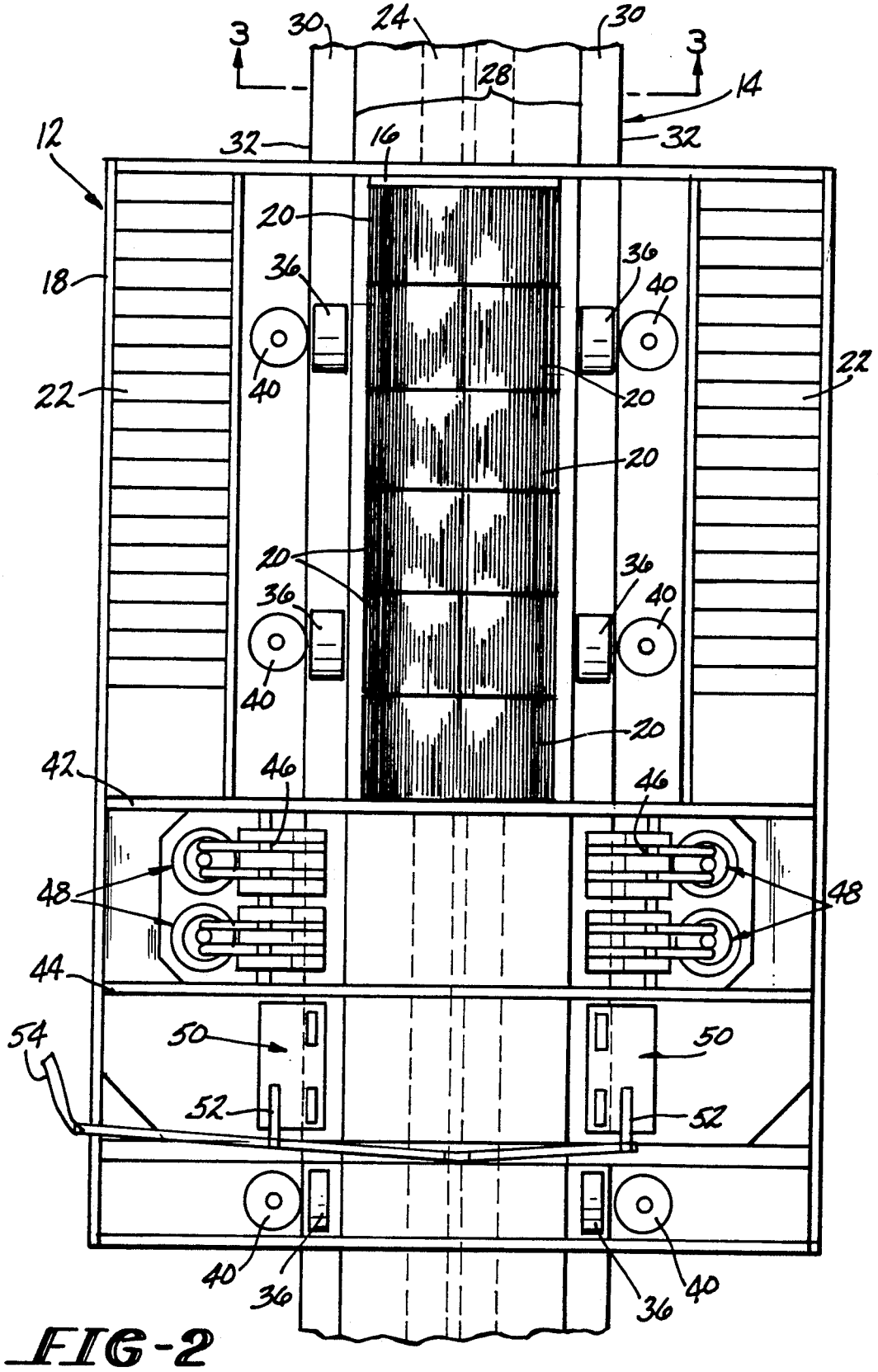
FIG. 2 is an elevational view of the counterweight of this invention showing the armature/counterweight guide.
Figure 4:
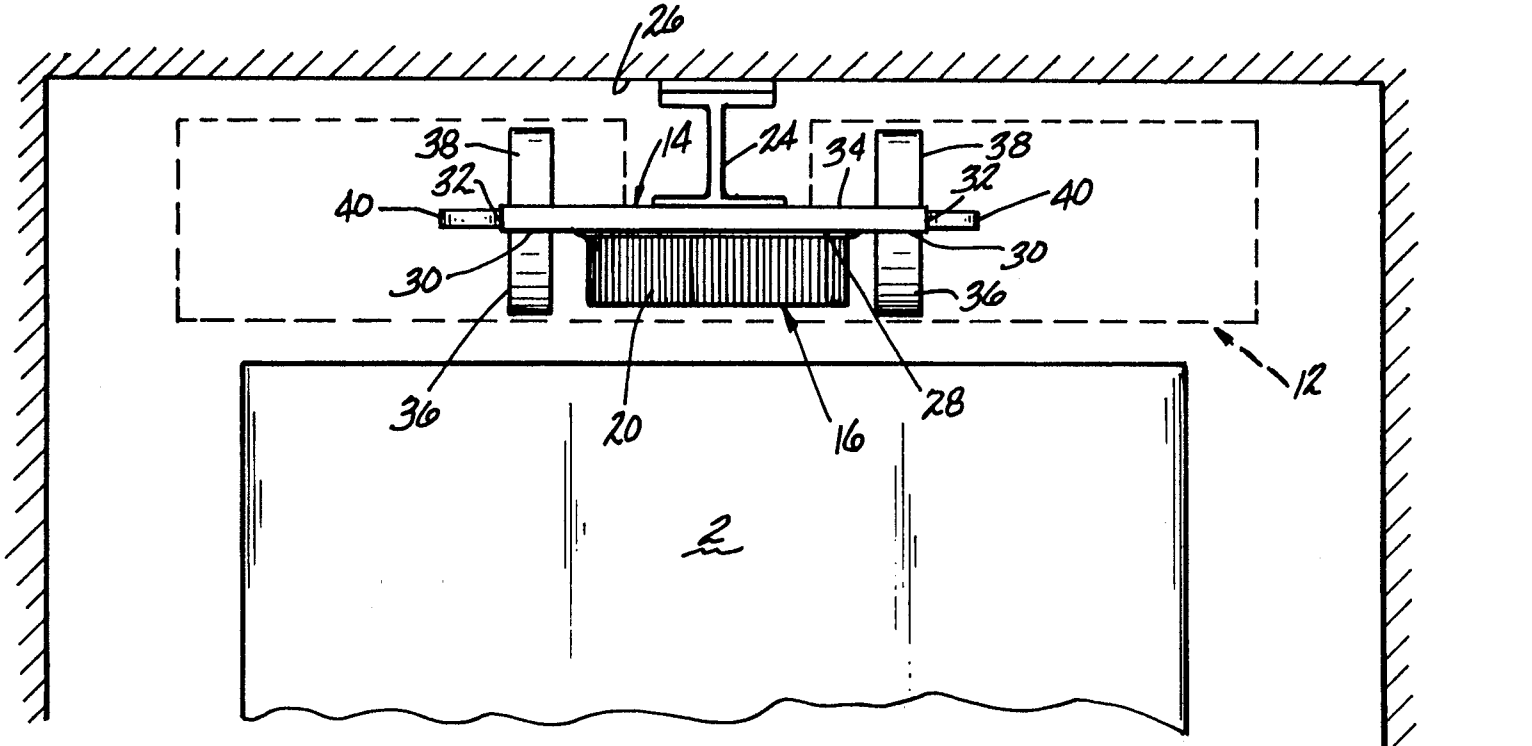
FIG. 4 is a fragmented plan view of the elevator assembly of this invention.
Figure 3:
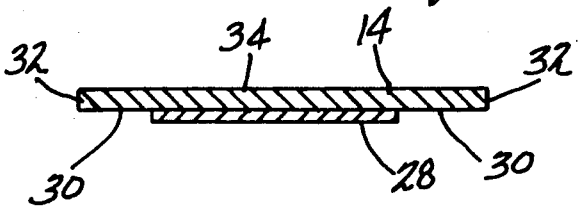
FIG. 3 is a transverse sectional view of the armature/guide member.

Referring now to FIG. 1, there is shown schematically an elevator assembly which derives its motive power from a linear motor mounted on the counterweight. In FIG. 1, the elevator car is denoted by the numeral 2, and is mounted in a hoistway for movement therein along guide rail 4. A pair of non-driven sheaves 6 and 8 are mounted in the top of the hoistway for engagement by a rope 10 which is connected to the car 2 and the counterweight assembly 12. The counterweight assembly 12 moves along a guide 14 mounted in the hoistway on an I beam 24, or a series thereof, which also serves as the armature for a linear motor 16 which is mounted on the counterweight assembly 12. The aforesaid is simply a general description if the category of elevator assembly to which this invention pertains. Referring to FIGS. 2–4, details of the counterweight 12, linear motor 16, and the guide 14 are shown. The counterweight assembly 12 has a frame 18 on which the various components of the counterweight assembly are mounted. The linear motor 16 is mounted on the frame 18 transversely centrally thereof, and is composed of a plurality of flat windings 20. Flanking the windings 20 are weights 22 mounted on opposite sides of the frame 18. The weights 22 are balanced so that the center of gravity of the assembly coincides with the vertical axes of the counterweight assembly 12.

The guide 14 is formed from an elongated flat strip of steel and is mounted in the hoistway by means of an I beam 24 secured to a hoistway wall 26. A layer or coating 28 of a highly conductive metal such as aluminum is deposited on the central part of the face of the guide 14 opposite the windings 20 on the linear motor 16. Both side margins 30 of the guide 14 are devoid of the coating 28, and are bare steel. The side surfaces 32 and the back surface 34 of the guide 14 are likewise uncoated and are bare steel. Journaled on the counterweight assembly 12 are sets of front and back rollers 36 and 38 respectively which engage the bare steel side margins 30 and the back surface 34 of the guide 14. The rollers 36 and 38 are operable to maintain an optimum gap between the conductive coating 28 and the linear motor windings 20 to ensure optimum operation of the device. Side thrust rollers 40 are also journaled on the counterweight assembly 12 to engage the bare steel surfaces 32 of the guide 14.

The counterweight frame 18 has a pair of spaced cross pieces 42 and 44 which receive the ends of a pair of rods 46 mounted on each side of the guide 14. Each of the rods 46 carries a pair of modular caliper brake assemblies 48, with the rods 46 forming pivot axes for the pairs of adjacent caliper brakes 48. Structural details of the caliper brakes 48 are set forth hereinafter. Mounted on the counterweight assembly 12 below the cross piece 44 and on either side of the guide 14 are emergency safety gears 50. The safety gears 50 overlie the margins 30 of the guide 14, but do not contact the aluminum layer 28. A pair of operating rods 52 are connected to the safety gears 58 and, are operable through a governor cable 54 connected thereto, to trip the safety gears 50 in case of free fall or overspeed of the counterweight 12. The safety gears 50 can be wedge-type brakes which will tightly grip the guide 14, but the coated armature portion 28 of the guide 14 will not be damaged. The same applies to actuation of the operating caliper brakes 48 since they will only contact the exposed steel margins 30, and will not touch the coated armature portion 28 of the guide 14.

Figure 4A:
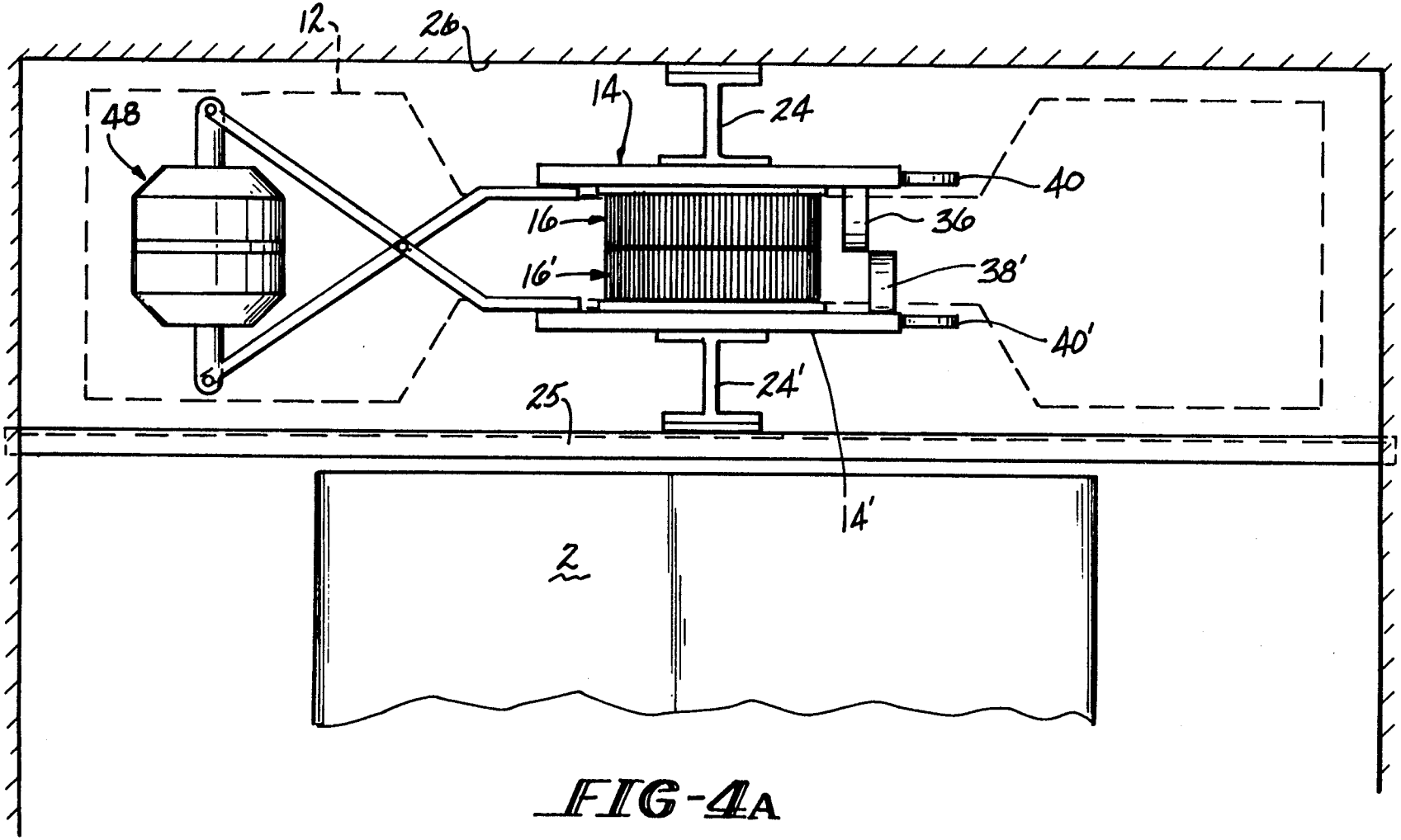
FIG. 4A is a fragmented plan view similar to FIG. 4 but showing an embodiment of the invention using two back-to-back linear motors with two guide rails.

In FIG. 4A there is shown a double face flat linear motor on the counterweight assembly 12. This embodiment includes two flat linear motors 16 and 16' disposed back-to-back on the counterweight assembly 12. Two flat steel strip guide/stators 14 and 14' constructed as described above are used. A stator support 24 connects the guide/stator 14 to the hoistway wall 26, and another stator support 24' connects the guide/stator 14' to cross beams 25 mounted in the hoistway between the counterweight assembly 12 and the car 2. Guide rollers 36 and 40 (only one set of which is shown) engage the stator 14 as previously described, while additional guide rollers 38' and 40' (only one set of which is shown) likewise engage the stator 14'. Electromagnetic operating tracks 48 (only one of which is shown) are mounted on both sides of the counterweight assembly for engagement with the steel edges of the guide/stators 14 and 14'. The brakes 48 wedge outwardly instead of inwardly so as to engage both guide/stators 14 and 14' when braking the counterweight assembly 12.

Figure 5:
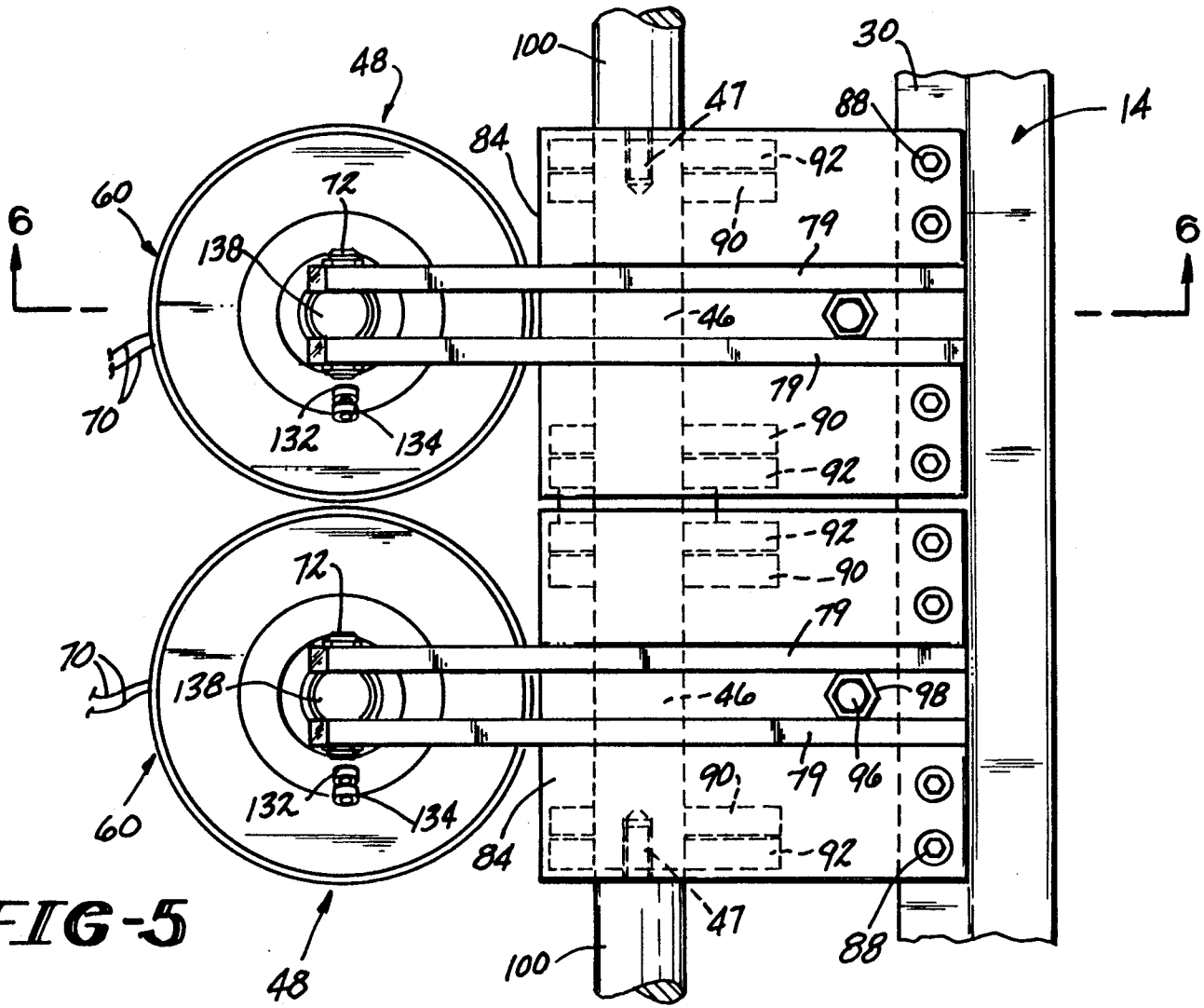
FIG. 5 is a plan view of one set of the modular operating brakes used on the counterweight.
Figure 6:
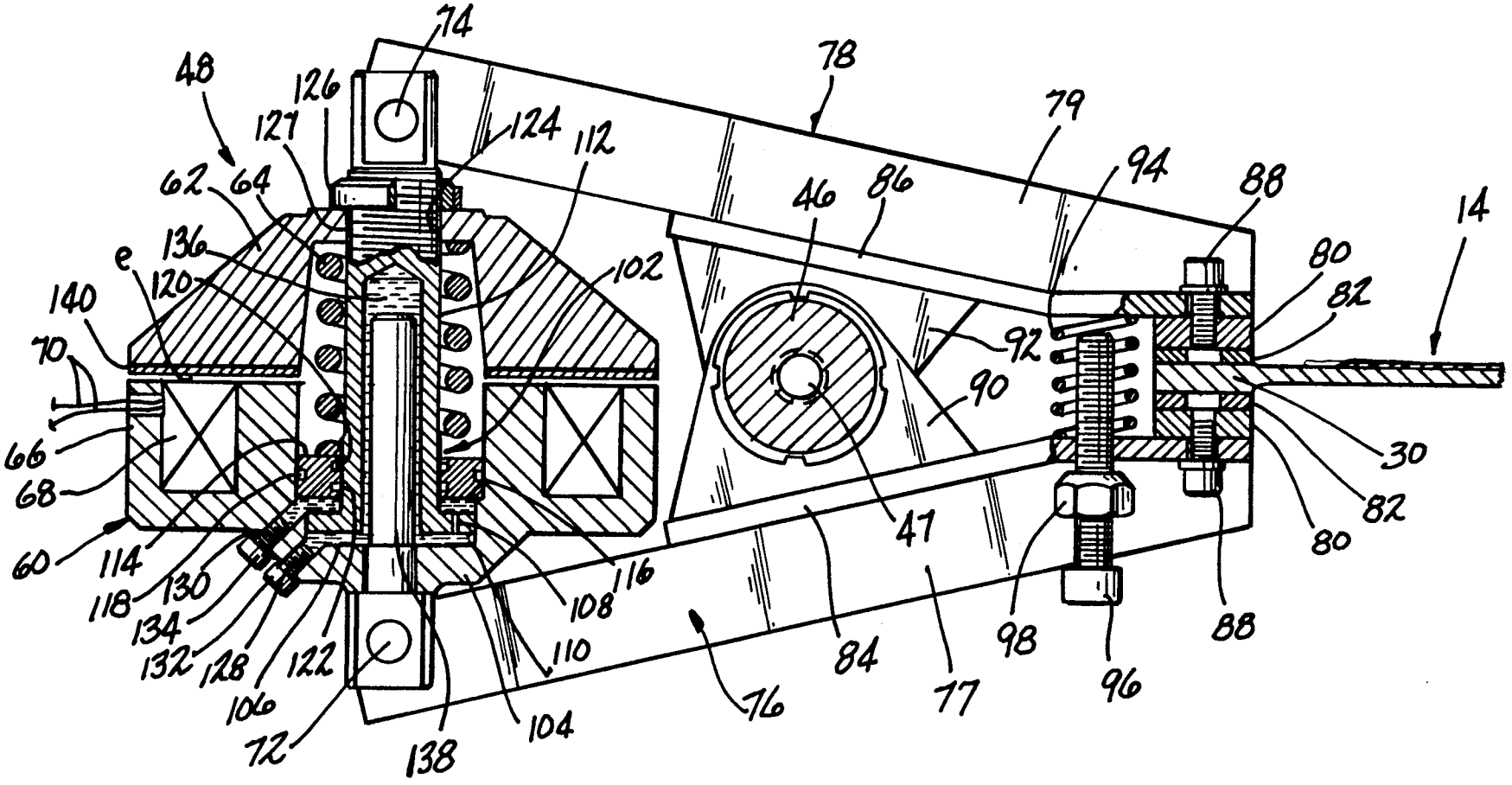
FIG. 6 is a sectional view of one of the modular brakes taken along line 6—6 of FIG. 5.

In the detailed configuration shown in FIGS. 5 and 6, the electromagnetic brake 48 comprises a coiled electromagnet 60 and a movable armature 62 made of soft iron, which is attracted by the electromagnet 60 when it is energized, and is separated from it by a spring 64 when not energized.

The electromagnet 60 comprises a frame 66 and a coil 68, which are supplied with direct current by a bank of rectifiers not shown, through conductors 70.

The electromagnet 60 and armature 62 are mounted in movable fashion respectively at 72 and 74 between two pivoting arms 76, 78 that support jaws 80, each of which is equipped with a brake shoe 82, intended to brake the counterweight 12 and car 2 by closing through the action of spring 64 on the exposed steel margins 30 of the guide 14. The arms 76, 78 are perpendicular to the guide 14.

In the example shown, each of the arms 76, 78 is formed of two parallel rib 77 and 79, respectively, which surround at one of their ends the corresponding links 72, 74, and are attached by welding for example, along a large portion of their length starting from the other end, to a plate 84, 86 which supports jaws 80. When the brake is closed the jaws 80 are parallel to margins 30 of the guide 14.

In the example shown in FIG. 5, the size of each plate 84, 86 in the longitudinal direction of rail 14 is the same as the outside diameter of electromagnet 60, and supports two jaws 80 each of which is equipped with a brake shoe 82 and are attached by screws 88.

As is previously noted the arms 76, 78 pivot around a common shaft 46 placed between the electromagnet 60 and the closing jaws 80, parallel to guide 14.

To this effect each plate 84, 86 has two support plates 90 and 92 respectively, which are attached perpendicular to them, by welding for example, toward the inside of the brake and parallel to arms 76, 78. These support plates 90, 92 are separated in the direction of shaft 46 and rail 14. The support plates 90, 92 are perforated respectively by straight openings that form bearings to receive shaft 46 and allow arms 76, 78 to pivot around it.

A small spring 94 helps to separate the jaws when the electromagnet is energized, in particular by taking up any play that may exist around shaft 46 and in the joints 72 and 74.

An unlocking bolt 96 located near jaws 80 in a threaded hole in plate 84 allows the jaws 80 to be separated against the counteraction of spring 64, to provide access to brake shoes 82 for maintenance when the brake is idle and normally closed. A nut 98, for example of the type known under the brand name of NYLSTOP, is screwed onto bolt 96 and is locked so that it cannot turn, but is free to transfer between ribs 77 of arm 76 to prevent any undesired movement of bolt 96 due to the force of spring 64.

The brake 48 is attached to its support by shaft 46 by any means known. Thus, in the configuration in FIG. 2, the two brakes 48 located on each side of guide 14 are each mounted on the same shaft 46, each of whose ends may have a threaded hole 47 that permits attachment of the shaft 46 to counterweight cross pieces 42 and 44 via mating stub axles 100.

According to the invention, brake 48 comprises a damper 102, which resists the movements of armature 62 with respect to the electromagnet 60 to control and slow the closing and opening speed of brake 48. As shown in detail in FIG. 6, damper 102 is located in the center of electromagnet 60, and its longitudinal axis blends with the axes of electromagnet 60 and armature 62.

In the example shown, damper 102 is a hydraulic damper which consists of a body 104, made of the empty central part of frame 66 of electromagnet 60 and a piston 106 that is an integral part of armature 62.

As shown in FIG. 6, a calibrated opening 108 traverses piston 106 and allows the hydraulic fluid in chamber 110 to flow to the inside of body 104 under pressure respectively exerted by electromagnet 60 when it is energized, and by the opposing spring 64 when it is not.

Body 104 is closed on the rod side 112 of piston 106 by a fixed base 114, which is traversed along its axis by rod 112. Base 114 is kept in place against an interior shoulder 116 on the inside surface of body 104 by the action of spring 64, and seals off chamber 110. To that effect as shown in the example, base 114 has a seal 118 on its external lateral surface to ensure tightness between it and the lateral inside surface of body 104, with respect to which it is fixed, and on its lateral inside surface there are two seals 120, to ensure tightness between it and the lateral surface of rod 112 of piston 106, which moves with respect to the base.

In the example shown, the external surface of rod 112 is threaded 124; the armature 62 has a threaded opening in its center and is screwed to rod 112. Armature 62 is locked in place by a locknut 126.

Body 64 is perforated by a filler orifice 128 for the part of chamber 110 located between piston 106 and body 104, and a filler orifice 130 for the part of chamber 110 located between piston 106 and base 114. Orifices 128 and 130 are respectively sealed by stoppers 132 and 134 which are for example screwed into threads on the respective insides of orifices 128, 130.

In the configuration of FIG. 6, piston 106 is traversed by a long axial opening which extends inside rod 112 of piston 106 into a cavity 136, and a guide shaft 138, which is one piece with body 104 of damper 102 and frame 66 of electromagnet 60, penetrates into this opening and into cavity 136. The outside diameter of shaft 138 is slightly less than the inside diameter of the opening and cavity 136, so that rod 112 may freely slide around shaft 138, while ensuring precise guidance of piston 106 and rod 112 and allows the hydraulic fluid to flow freely between rod 112 and shaft 138' between the bottom of cavity 136 and the part of chamber 110 located between piston 106 and base 114.

To assemble damper 102 and electromagnet 60, the shaft 138 is locked in sealed form, for example by a bolt, to the axis of frame 66 of electromagnet 60; piston 106 and its rod 112 are threaded to shaft 138; base 114 is equipped with its seals 118, 120, 122 and placed into position; spring 64 is placed around rod 112; armature 62 is screwed to rod 112 above spring 64 and the threaded locknut 126 is placed on the outside thread 127 of rod 39. Then nut 126 is closed to adjust the space between electromagnet 60 and armature 62. After that, arm 76 is assembled to shaft 138 by joint 72, and arm 78 is assembled to rod 112 by joint 74. Finally the hydraulic liquid is poured through one of filler orifices 128 and 130 to completely fill the two parts of chamber 110 on both sides of piston 106 without trapping any air.

As indicated in FIG. 6, a thin plate 140 made of a nonmagnetic material such as bronze, aluminum or stainless steel, is attached to the face of armature 62 with respect to electromagnet 60, to prevent armature 62 from sticking to electromagnet 60 by residual magnetism when the latter is de-energized.

The operation of electromagnet brake 48 in accordance with the invention is now explained.

The electromagnetic brake 48 is shown in FIG. 6 in the locked position; electromagnet 60 is not energized, spring 64 tends to separate frame 66 of the electromagnet and armature 62 from each other; arms 76 and 78 have pivoted around shaft 46 and transmit the force of spring 64 to the jaws 80 and brake shoes 82 which are locked on the margin 30 of the guide 14.

When coil 68 of electromagnet 60 is energized by conductors 70, the magnetic force produced by electromagnet 60 is greater than the force of spring 64 and armature 62 is attracted to frame 66 against the action of spring 64 and against the action of damper 102. The attraction force of armature 62 is transmitted by rod 112 to piston 106. Under the effect of this pressure, the hydraulic fluid contained in the part of chamber 110 located between piston 106 and body 104 flows through calibrated orifice 108, which allows the piston 106 to be displaced toward body 104 until the plate 140 touches frame 66 and the hydraulic fluid pressure on both sides of piston 106 is the same.

Brake 48 is then in its released position, the jaws 80 have separated, the brake shoes 82 no longer grip the guide 14. Spring 94 also acts to separate jaws 80 to their maximum and to take up any play that may exist around shaft 46 and in joints 72 and 74.

It should be noted that in this released position, no restraint is exerted on the different joints 72, 74 and on shaft 46, except for that created by springs 94, which is very weak, so that brake 48 is essentially free around its shaft 46, which creates a self-centering effect on brake 48 with respect to the guide 14 preventing any friction of one of brake shoes 82 against margins 30 of the guide 14, thus preventing any wear.

It should also be noted that in the configuration example described and shown, the resistance opposed by damper 102 to the displacement of armature 62 is greater in the released position of the brake than in the locked position, because the surface of the piston on the body side, which is activated first, is larger than the surface on the rod side, which is activated secondly; this corresponds to the fact that the chatter of armature 62 on frame 66 during brake release is noisier than the chatter of brake shoes 82 against the margins 30 of the guide 14 when the brake locks, in spite of the presence of plate 140.

Thus, the merit of the brakes 48 is to associate an electromagnet with a damper designed to be able to act efficiently in spite of the very short stroke of the armature to one side and the other, without essentially modifying the space occupied by the electromagnet in the advantageously simple and compact mechanical structure, and to propose a brake particularly adapted to the new technology of elevators activated by linear motors, which significantly improves the comfort and safety of the passengers.

The electromagnetic brake according to the invention has a simple structure that allows silent and smooth operation, while being very reliable and resistant to wear.

Specialists in this field will understand that in the case of an elevator activated by a linear motor, it is advantageous as a function of response time of damper 102, to carefully regulate on the one hand the instant when the brake closes with respect to the instant when the current is cut off while maintaining the counterweight and the cabin immobile, on the other hand the instant when the brake is released with respect to the instant when the linear motor is energized to start the elevator moving. The response time of the damper depends obviously on its characteristics, the respective forces of electromagnet 60 and counteracting spring 64 and the viscosity of the hydraulic fluid.

It should be noted that, with regard to the viscosity of the hydraulic fluid, the construction of the just described electromagnetic brake with a damper in the axis of the electromagnet, causes the fluid to become warm from heat released by the electromagnet, and does not run the risk of cooling during a period of normal elevator utilization.

If the fluid is congealed during heavy frost, the brake will be blocked and the elevator will not start. Repeated attempts to start the elevator by sending current through the electromagnet would then quickly heat the hydraulic fluid, while safety would remain assured under all conditions.

It will be readily appreciated that the guide structure for the linear motor and the counterweight assembly is compact and is capable of performing with the guiding and braking functions, as well as serving as the armature for the linear motor without the risk of harm to either function. The guide can be easily mounted in an elevator hoistway, and its flat configuration reduces its weight and allows it to be installed in higher rise buildings. The guide is capable of providing a brake surface for both the operational electromagnetic brakes, and also for emergency safety gears. The use of modular electromagnetic brakes on the counterweight assembly enables the total braking force to be varied simply by adding or subtracting brake modules fixed to the counterweight assembly. There will always be an even total number of the modular brakes, with half of the brake cooperating with each margin of the guide. The fact that the brakes are silenced is advantageous in the elevator environment.

Since many changes and variations of the disclosed embodiment of the invention may be made without departing from the inventive concept, it is not intended to limit the invention otherwise than is required by the appended claims.

What is claimed is:

1. An elevator assemblage of the type which derives motive power for movement through a hoistway from a linear motor mounted on an elevator counterweight assembly, said elevator assemblage comprising:

a) a counterweight frame;

b) a flat linear motor mounted on said counterweight frame, said linear motor being mounted centrally on said frame whereby said frame includes side portions which in part flank said linear motor;

c) a flat steel strip disposed adjacent said counterweight frame, said steel strip being elongated in the vertical direction of the hoistway, said steel strip including a central portion facing said linear motor, which central portion is coated with a highly electrically conductive material coating whereby said coated central portion of said steel strip serves as a stator for said linear motor and said steel strip having side margins flanking said central portion which are uncoated exposed steel; and d) brake means mounted on said counterweight frame for engaging only said exposed steel side margins of said steel strip to selectively stop movement of said counterweight assembly in the hoistway.

2. The elevator assemblage of claim 1 further comprising guide rollers on said frame for engaging only said side margins of said steel strip to guide movement of said counterweight assembly over said steel strip, and to maintain a preferred spacing between said linear motor and said stator.

3. The elevator assemblage of claim 2 further comprising side rollers mounted on said frame for engaging side edges of said steel strip to control side thrust of said counterweight assembly in the hoistway.

4. The elevator assemblage of claim 1 wherein said brake means comprise an even number of electromagnetic brake modules, with one half of said even number of brake modules being mounted on one side portion of said frame, and with the other half of said even number of brake modules being mounted on an opposite side portion of said frame, said brake modules being operable to selectively engage said steel side margins of said steel strip to control floor stopping of the elevator assemblage.

5. The elevator assemblage of claim 4 wherein said brake means further comprises safety gears mounted on said side portions of said frame for selectively engaging said steel side margins of said steel strip for emergency stopping of said counterweight assembly.

6. A stator/guide member for use with a linear motor elevator assemblage, said member comprising an elongated flat steel strip having a medial portion of one surface thereof coated with a layer of a highly electrically conductive material; and said steel strip having marginal edge portions thereof which are formed from exposed steel, said medial portion of said strip serving as a stator for a linear motor carried by a component of the elevator assemblage, and said marginal edge portions of said strip serving as contact surfaces for brakes disposed on the component of the elevator assemblage which carries the linear motor.

7. An elevator assemblage of the type which includes a counterweight assembly having a linear motor mounted thereon for deriving motive power for moving the assemblage through a hoistway, said assemblage comprising:

a) an elongated stator/guide member in the hoistway adjacent to the counterweight assembly, said member being formed from steel and having a stator portion thereof coated with a layer of a highly electrically conductive material, said stator portion of said member being closely adjacent to said linear motor, and said member further including exposed steel contact surfaces for controlling movement of the counterweight assembly in the hoistway, b) a plurality of guide rollers mounted on said counterweight assemblage and disposed in contact with said contact surfaces on said stator/guide member, said guide rollers being operable to position said counterweight assembly on said stator/guide member and being free of contact with said stator portion of the latter, and c) brake means mounted on said counterweight assembly, said brake means being operable to stop movement of said counterweight assembly by selectively engaging said contact surfaces on said stator/guide member and said brake means being at all times free of contact with said stator portion of said stator/guide member.

8. An elevator counterweight assembly comprising:

a) a frame;

b) a flat linear motor mounted centrally on said frame;

c) an even number of electromagnetic brake modules mounted on said frame, with one half of said even number of brake modules being mounted on said frame to one side of said linear motor, and the other half of said even number of brake modules being mounted on said frame to the opposite transverse side of said linear motor; and d) an emergency safety gear mechanism mounted on said frame in co-alignment with said brake modules.

* * * * *